United States Patent [19]

Troncoso, Jr.

[11] 4,398,528

[45] Aug. 16, 1983

[54] ARCHERY BOW ASSEMBLY

[76] Inventor: Fernando Troncoso, Jr., 1851 S. Orange Ave., Monterey Park, Calif. 91754

[21] Appl. No.: 338,334

[22] Filed: Jan. 11, 1982

[51] Int. Cl.[3] ..... F41B 5/00

[52] U.S. Cl. ..... 124/24 R; 124/41 A

[58] Field of Search ..... 124/41 A, 24 R, 86, 124/88

[56] References Cited

U.S. PATENT DOCUMENTS

| | | | |
|---|---|---|---|
| 3,865,096 | 2/1975 | Troncoso . | |
| 3,935,854 | 2/1976 | Troncoso | 124/41 A X |
| 4,236,497 | 12/1980 | Troncoso . | |
| 4,332,232 | 6/1982 | Troncoso | 124/41 A X |

FOREIGN PATENT DOCUMENTS

| | | | |
|---|---|---|---|
| 2908809 | 9/1980 | Fed. Rep. of Germany | 124/41 A |

OTHER PUBLICATIONS

Pacesetter-Archery Magazine, Jul. Issue, page not known, 1975.

*Primary Examiner*—William H. Grieb
*Assistant Examiner*—William R. Browne
*Attorney, Agent, or Firm*—Donald E. Nist

[57] ABSTRACT

An improved archery bow assembly is provided which includes an archery bow having an arrow shelf and sidewall defining an arrow window, an archery arrow and an improved arrow rest disposed in and behind the window and supporting the arrow in the window for shooting. The rest includes a bracket, and first and second arrow supports connected to the bracket and supporting the bottom and at least one side of the arrow. The bracket has an arm releasably locked to the sidewall through an elongated slot, which arm extends horizontally rearwardly of the bow and is interconnected to a rear connector plate. A horizontal transversely extending cross arm passes through and is clamped in the connector below the rearwardly extending arm. The cross arm bears in a slot thereof the first arrow support in the form of an upwardly and forwardly extending flexible blade, preferably having a small raised flange at the outer margin of its forward end. The cross arm is rotatable to set the angle of the blade. The second arrow support may be a second blade secured to a cross bar positively locked to the connector plate above the cross arm, and/or may be a cushion plunger secured to the sidewall. The assembly provides positive clearance of the bracket from the bow hand and the arrow during firing of the arrow, and permits maximum adaptability of the rest to various sizes and types of arrows and bows.

5 Claims, 3 Drawing Figures

ARCHERY BOW ASSEMBLY

BACKGROUND OF THE INVENTION

1. Field of the Invention

The present invention generally relates to archery and more particularly to improvements in an archery bow assembly.

2. Prior Art

The usual type of arrow rest is a fixed horizontal ledge attached to the bow sidewall and jutting out into the window above the handle and arrow shelf. The rest may be fabricated of feathers, of leather, plastic or the like and is adapted to support an arrow in the window from below. It presents a potential problem to the archer in that the arrow feathers or vanes, and even the shaft in some instances, may strike the rest as the arrow moves forward immediately after bowstring release. Such striking slows the arrow, wears and eventually damages the vanes and rest, causes arrow wobble and reduces shooting accuracy. As the vanes or feathers wear, they also cause the arrow to change its point of impact and reduce accuracy, a critical factor in target archery and also in hunting, where the hunter may only have a few real opportunities over a several day period to make a kill. Each arrow released must be accurate.

Striking of the rest can be avoided if the rest is made narrow enough and if the arrow shaft flexes or bends laterally enough upon release of the bowstring, thus following a pronounced S-curve, as may be the case when the fingers or a finger tab or glove are used in drawing and releasing the bowstring. However, when a mechanical bowstring release is used to draw and release the bowstring, such lateral flexing is diminished very noticeably. This is even more the case when a compound archery bow is shot with a mechanical bowstring release. Moreover, a narrow rest increases the likelihood of the arrow rolling off the rest during hunting before release of the bowstring, thus causing a wild shot. Most arrow rests cannot be adjusted sufficiently to adapt them to various types of archery shooting, to arrows of different diameters and flex characteristics and to other variables. It would be desirable to be able to impart such adaptability to an arrow rest in a simple inexpensive manner.

Certain arrow rests employ a hinged wire component which is held magnetically in an arrow-supporting position and bridges the gap to the sidewall but which swings forward and closes when struck by the arrow vane or feather. If such a wire is jiggled, it can prematurely close, dropping the arrow to the shelf. While such rests reduce arrow wear and deflection, those effects are still noticeably present. Archery shooting requires extreme accuracy to hit distant mobile game and other targets. Therefore, it would be highly desirable to be able to provide an improved archery assembly which could assure complete clearance of the arrow shaft and vanes from the bow upon shooting the arrow and also positive holding of the arrow to prevent its inadvertent roll off or fall through the rest.

There is also a further factor to consider. Whether the bow is shot with the bow hand held open and a finger or wrist strap used, or with a closed bow hand, during drawing of the bow the bow hand and arm are placed under considerable tension. Any inadvertent contacting of the bow hand by the arrow rest, such as by a supporting bracket for the rest, etc. will inevitably cause substantial shooting inaccuracy to arise, as well as possible injury to the bow hand. Such is also the case if the contacting occurs during or slightly after release of the bowstring during shooting. Certain arrow rests are particularly prone to this defect. Accordingly, it would be highly desirable to provide an arrow rest which features freedom from contact of the rest with the bow hand during shooting of the bow. Such device should provide a maximum of adjustability and be capable of easily holding its components in proper alignment during extended use of the bow.

SUMMARY OF THE INVENTION

The improved archery bow assembly of the present invention satisfies all the foregoing needs. The assembly is substantially as set forth in the Abstract above. Thus, it includes an archery bow with arrow window, an arrow and a rest holding the arrow in the window in such a manner that the arrow will not roll off or drop through the rest and still will, upon bowstring release, shoot through the bow in an unimpeded flight without striking the rest or bow sidewall or shelf. Moreover, the rest can be adjusted to accommodate arrows of all sizes, flexibilities, etc.

The rest features two resilient arrow supports contacting the bottom and inner and preferably outer margins of the arrow shaft to prevent arrow roll off or fall through. The bottom support is in the form of a spring blade biased to flex down out of the way as the arrow is shot from the bow. A cross arm secured to the bow and disposed in the area behind the window supports the rear end of the bottom support and can be adjusted to fully control the biasing force and position of the bottom support.

This bracket includes a rearwardly extending horizontal arm secured to the bow sidewall through an elongated slot. A connector plate is interconnected to the rear end of that arm, the plate in turn holding one end of the cross arm in a releasable clamped position below the rearwardly extending arm. A transverse cross bar spaced above the cross arm can also be attached to the connector plate and bear a spring blade extending forward into the window near the sidewall and serving as the second arrow support. In one embodiment the second blade is backed by a laterally extending cushion plunger. In another embodiment the cushion plunger is substituted for that blade.

The cross bar, when present, preferably is positively locked to the connector plate by a screw seated in a groove in the cross bar.

The assembly is simple and inexpensive, provides positive arrow and bow hand clearance and can be used equally well with arrows and bows of all sizes and types. Further features are set forth in the following detailed description and accompanying drawings.

DRAWINGS

DETAILED DESCRIPTION

FIGS. 1-3

Figure 1:
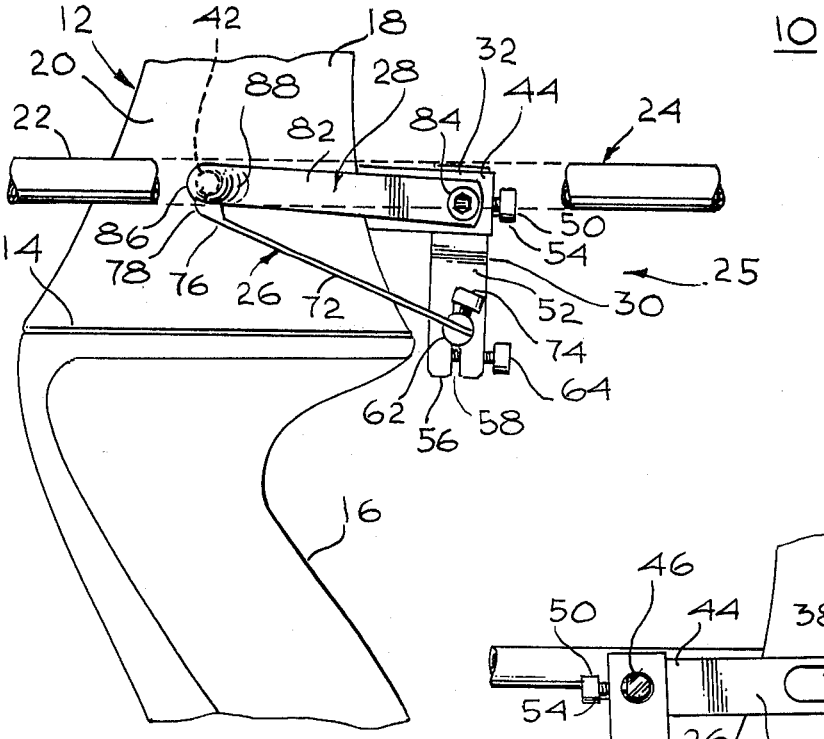
FIG. 1 is a schematic fragmentary side elevation of a preferred embodiment of the improved archery bow assembly of the present invention, showing the window side of the bow with the improved arrow rest installed therein and holding an arrow in place.

Now referring more particularly to the accompanying drawings, an improved archery bow assembly is schematically depicted therein. Thus, assembly 10 is shown which comprises an archery bow 12 of the longbow or recurve type, compound type or the like having a shelf 14 above a handle 16, and also having a sidewall 18. The shelf 14 and sidewall 18 define a window 20 within which the shaft 22 of an arrow 24 is supported by an arrow rest 25.

Figure 3:
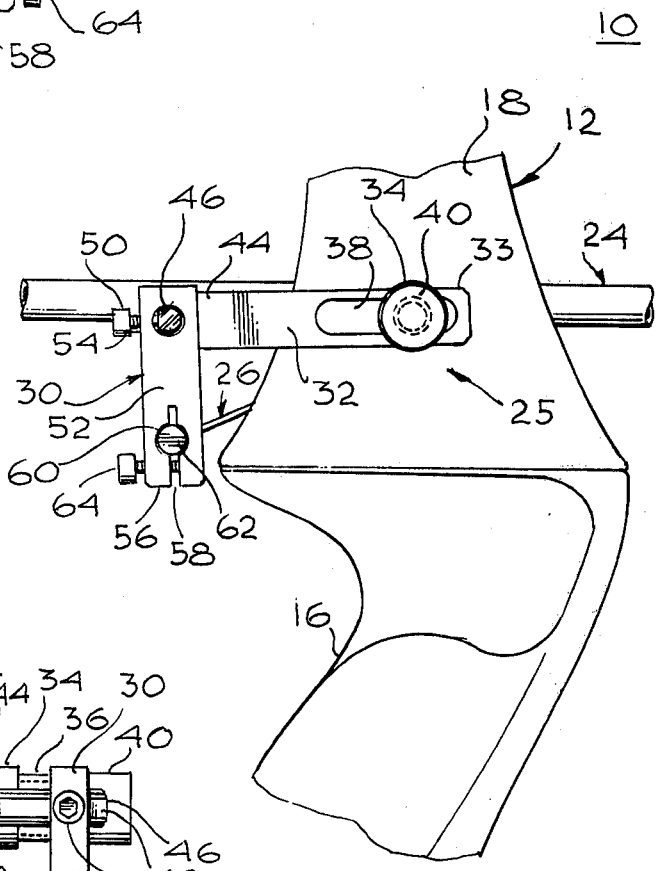

Rest 25 comprises first and second flexible resilient depressible arrow supports 26 and 28 connected to a support bracket 30. Bracket 30 includes a generally horizontal rearwardly extending arm 32, the front end 33 of which is releasably secured to sidewall 18 on the side opposite window 20 by an enlarged nut 34 threadably disposed on a screw 36 extending transversely through sidewall 18 and an elongated narrow opening 38 extending transversely through arm 32 (FIG. 3). Opening 38 permits horizontal arm 32 to be moved forwardly and rearwardly relative to handle 16 in order to adjust the exact position of bracket 30 for maximum arrow and bow hand clearance.

Figure 2:
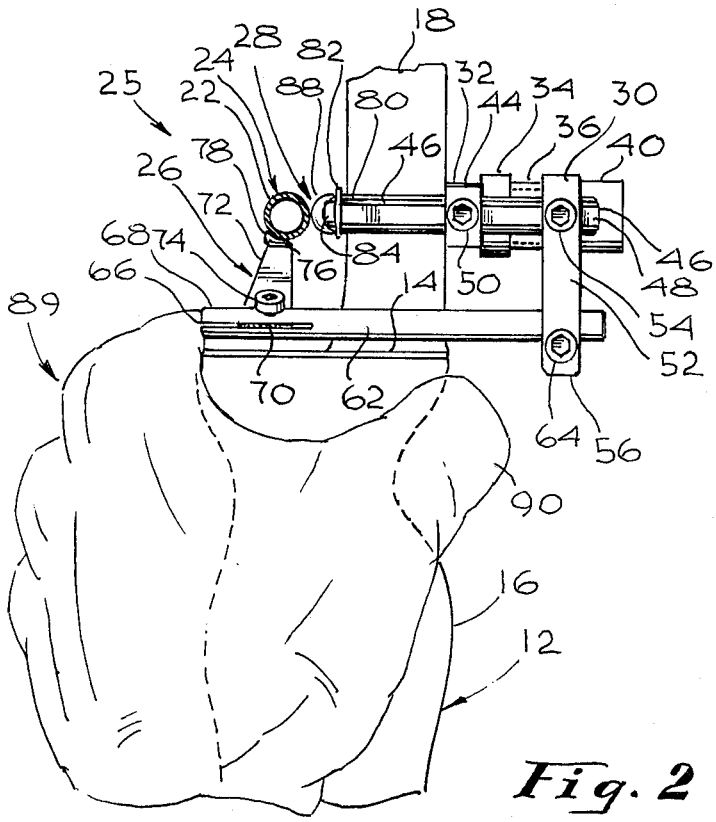
FIG. 2 is a schematic fragmentary rear end view of the improved archery bow assembly of FIG. 1, showing a bow hand in place around the handle of the bow; and, FIG. 3 is a schematic fragmentary side elevation of the improved archery bow assembly of FIG. 1, showing the side of the bow opposite that shown in FIG. 1.

Nut 34 and screw 36 may comprise, as shown in FIGS. 1, 2 and 3, portions of a conventional spring loaded cushion plunger 40, the head 42 of which is spring biased laterally into window 20 and forms part of arrow support 28, as more particularly described hereafter.

The rear end 44 of arm 32 is connected to a horizontally extending cross bar 46 disposed transversely of bow 12 behind sidewall 18. Bar 46 passes transversely through end 44 and bears a rearwardly facing longitudinal groove 48 into which a screw 50 is positively seated after passing forwardly through end 44. Groove 48 prevents bar 50 from rotating out of alignment.

Spaced parallel to and lateral of end 44 on bar 46 is a connector plate 52 which depends below bar 46 and is releasably secured to bar 46 by a forwardly extending screw 54 passing through plate 52 and into groove 48. The lower end 56 of plate 52 is divided to form a transverse slot 58 extending up therethrough to a transverse aperture 60 through which a transverse cross arm 62 is slideably received. A screw 64 is threaded forward through end 56 to bridge slot 58, and releasably clamp arm 62 in place by uniformly decreasing the size of aperture 60.

Arm 62 extends behind sidewall 18 from end 56 to a point behind window 20 and includes a longitudinally extending slot 66 in end 68 thereof in which is slideably received the rear end 70 of flexible resilient blade 72 forming arrow support 26. Blade 72 is releasably held in place in slot 66 by a screw 74, and can be repositioned relative to sidewall 18 since slot 66 is wider than end 70. Blade 72 can also be positioned by sliding cross arm 62 in aperture 60 after loosening screw 64. Blade 72 slopes forwardly and upwardly, so that its narrow curved front end 76 supports the underside of shaft 14 by an essentially point contact. End 76 preferably includes a slightly raised flange 78 on the outer margin thereof to prevent shaft 14 from rolling off end 76.

In the embodiment shown in FIGS. 1, 2 and 3, transverse cross bar 46 extends to a position behind window 20 and above cross arm 62 and bears on the end 80 thereof an about horizontally and forwardly extending flexible blade 82 releasably secured thereto, as by a screw 84. The main plane of blade 82 is about vertical. Front end 86 of blade 82 preferably has a generally laterally extending curve 88 therein, bulging towards shaft 22 which curve 88 provides point contact with the side of shaft 22 and spaces it a suitable distance from sidewall 18. Front end 86 is backed by head 42 of cushion plunger 40, so that end 86 is resiliently biased away from sidewall 18. Blade 82 and head 42 cooperate to form arrow support 28. Thus, shaft 22 is supported by blades 72 and 82 and head 42, flange or lip 78 aiding in the support.

The spacing of shaft 22 from sidewall 18 is adjustable, as by adjusting blades 72 and 82 and head 42, arm 62 and bar 46, as desired, to prevent shaft 22 and the vanes (not shown) of arrow 24 from striking sidewall 18 and other parts of bow 12. Moreover, arm 62, bar 46 and plate 52 can easily be adjusted so that arm 62 and plate 52 easily clear the bow hand 89 (FIG. 2), especially thumb 90, before, during and after shooting, in contrast to conventional bracket type arrow rests which commonly strike the archer's bow hand during use of an archery bow.

It will be understood that the described flexibility and adjustability of rest 25 allow various sizes and flexibilities of shaft 22 to be used with various sizes of arrow vanes and various strength bows while still providing total arrow clearance and total support of arrow 24 on rest 25, all without contacting bow hand 88.

Rest 25 can be made of aluminum, steel and/or other metal components, as well as plastics, etc. in a simple, inexpensive, durable manner. Either of blade 82 and plunger 40 could be used in rest 25 alone rather than both together, as shown in FIGS. 1, 2 and 3. Moreover, blade 72 could be in the form of a curved wire or the like, if desired. Other changes, alterations, modifications and additions can be made in assembly 10, its components and their parameters. All such changes, modifications, alterations and additions as are within the scope of the appended claims form part of the present application.

What is claimed is:

1. An improved archery bow assembly, said assembly comprising in combination:

A. an archery bow having an arrow shelf and sidewall defining an arrow window;

B. an archery arrow; and,

C. an improved arrow rest disposed in and behind said window and supporting said arrow in said window for shooting from said bow, said rest including i. a bracket having a. a generally horizontal arm releasably secured to said sidewall on the side thereof opposite said window and extending rearwardly of said window, b. a connector interconnected to and depending below said horizontal arm adjacent the rear end thereof, c. a generally horizontal cross arm adjustably clamped in said connector and extending transversely of said bow from said opposite side to a position directly behind said window, ii. a first flexible resilient depressible arrow support releasably connected to said cross arm behind said window, extending into said window adjacent said sidewall and supporting the bottom of said arrow shaft;

iii. a second, flexible resilient arrow support extending into said window and supporting and spacing said shaft from said sidewall and, the rear end of said first arrow support being disposed below the front end of said second arrow support and being releasably and laterally adjustably secured in a horizontal slot in said cross arm, said cross arm being rotatable in said connector to adjust the height of the front end of said first arrow support; and, iv. a generally horizontal cross bar interconnecting said connector and said rearwardly extending horizontal arm above said cross arm, and extending transversely of said bow from said connector to a position directly behind said window.

2. The improved archery bow assembly of claim 1 wherein said second arrow support is releasably secured to said cross bar and extends forward into said window adjacent said sidewall.

3. The improved archery bow assembly of claim 2 wherein each of said first and second arrow supports comprises a spring blade.

4. The improved archery bow assembly of claim 3 wherein said second arrow support includes a laterally extending cushion plunger secured to said sidewall and disposed between and contacting said second blade and said sidewall.

5. The improved archery bow assembly of claim 1 wherein said cross bar extends transversely through said connector and includes a crescent shaped longitudinally extending groove in which a screw extending through said connector is positively seated to support said cross bar against turning.

* * * * *